US005131657A

United States Patent [19]

Hughes

[11] Patent Number: 5,131,657

[45] Date of Patent: Jul. 21, 1992

[54] PUTTING PRACTICE IMPLEMENT

[76] Inventor: Michael J. Hughes, 4827 Rio Vista Ave., San Jose, Calif. 95128

[21] Appl. No.: 707,167

[22] Filed: May 24, 1991

[51] Int. Cl.[5] ..... A63B 69/36

[52] U.S. Cl. ..... 273/177 R; 273/34 R; 273/183 E; 273/184 A

[58] Field of Search ..... 273/178 R, 178 A, 178 B, 273/177 R, 177 A, 177 B, 34 R, 34 A, 34 B, 184, 185

[56] References Cited

U.S. PATENT DOCUMENTS 2,041,119 5/1936 Duganne ..... 273/34 R 3,424,464 1/1969 Greenhouse ..... 273/178 R

*Primary Examiner*—George J. Marlo

*Attorney, Agent, or Firm*—Michael J. Hughes

[57] ABSTRACT

A putting green practice implement (10) is provided for facilitating putting practice for golfers. The implement (10) is intended for use on a putting green (12) or similar surface and is especially intended for use in conjunction with an alignment aiding device such as a visual or electronic putter aligner. The implement (10) includes a moderately massive, flexible base member (20) for resting on the surface (12) and an extension member (22) for optionally depending into a putting cup (16) to secure the position of the implement (10). The preferred embodiment of the implement is characterized by a cup rim portion (32) approximating the regulation cup, a return slope (36) on the rear edge (34) for an alternate target, and an array including a pair of bar channels (64,66) and a receiving slot (40) for facilitating retraction of the extension member (22) such that the lower surface (24) of the implement will rest flat on surfaces when no putting cup (16) is utilized.

18 Claims, 3 Drawing Sheets

PUTTING PRACTICE IMPLEMENT

TECHNICAL FIELD

The present invention relates generally to support apparatus and more particularly to devices utilized to support visual and/or electronic components on a golf putting green. The preferred embodiment of the present invention is a golfer's putting practice implement adapted for use in supporting any of a variety of target components. The implement is particularly adapted to mate with the standard golf hole for added stability or to be utilized as a stable component on an area of the putting green or other putting surface which does not include a hole.

DESCRIPTION OF THE PRIOR ART

As any average golfer will testify, the game of golf is frustrating in the extreme. The game involves a stationary ball which is to be propelled toward the stationary target. A great deal of frustration occurs as a result of a golfer's inability to successfully and consistently accomplish the apparently simple goal.

One area of which leads to an extreme degree of frustration is that of putting. Under ideal conditions, putting involves propelling the stationary golf ball over a relatively short distance on a beautifully textured surface. Although there is a frequently a degree of slope to the surface and a variable topography, the "speed" and "break" of a particular putt usually seem to be apparent to a percipient golfer. Accordingly, when the golfer continually misses putts which would appear to be difficult to miss, a very high degree of frustration occurs.

In this light, it is not surprising that many golfers become obsessed with the practice of the putting stroke. It is not uncommon to see executives practicing their putting stroke on their office carpets or to see average golfers spend hours on the putting green of a golf course. It is also not uncommon for golf enthusiasts to install real or artificial putting surfaces in their homes.

Since, it is not really necessity but frustration that is often the mother of invention, and since golfers are rife with frustration, a great number of devices and technological advancements have been conceived and developed to aid in the perfection of the putting stroke. A perusal of golf magazines and catalogs over the years shows an extremely wide variety of devices and implements adapted to aid the putter in practicing, in order to obtain a perfect stroke. Several of these have been mechanical in nature while others are merely layouts of appropriate putting materials.

One of the most common and enduring devices is an artificial putting cup which is adapted to be utilized on a variety of surfaces, primarily carpets. Devices of this nature, such as the "Birdie" and "Nineteenth Hole" brands, provide a target for the putter to aim at and a receptacle for receiving the ball which is properly delivered to the target. Some devices include elements such as a mechanical or gravity feed ball returns which return the ball to the putter for further practicing. Others include sensory feedback means to encourage the proper completion of the putting stroke. These include flashing lights, bells, music and the like.

Recent developments have included various means for aiding a golfer in directly aligning the putter, and hence the putter stroke, with a particular target. Some of these includes visual aids, such as a small flag extending upward from the putting target. Of course, on a real golf course or a standard putting green, a small flag or numbered post is ordinarily placed within the cup to provide a target for putting. These devices, although effective in their own way, have not had the versatility which may be desired. For example, devices adapted to be placed within the cup portion of the golf hole are not appropriate for use on a carpet or on an area of the putting green in which the cup has not been cut. Furthermore, devices adapted for use on a carpet or another flat surface would tend to occlude a portion of the golf hole if utilized on an actual putting green. Furthermore, these devices are not ordinarily intended to provide cushioning and displaced support to sensitive components such as electronic elements, such that these will not be affected adversely by the impact of a putted golf ball.

For all of the above reasons it is desirable to provide a putting green implement which is adaptable for use in a wide variety of circumstances and is further capable of supporting associated apparatus for aiding the putter in alignment and/or other aspects of practice.

BRIEF DESCRIPTION OF THE INVENTION

Accordingly it is an object of the present invention provide an implement for aiding the practice of golf putting which is stable on a wide variety of surfaces.

It is another object of the invention to provide a putting practice implement which interfaces with a golf hole in order to provide increased stability.

It is a further object of the putting implement of the present invention to provide stable and cushioned support for electronic components associated with putting practice.

It is yet another object of the present invention to provide a versatile support structure which may be stable on a variety of surfaces, including putting greens and carpets.

It is still another object of the present invention to provide a device which is utilizable in at least two different rotational orientations for putting practice.

Briefly, the preferred embodiment of the present invention is a putting practice implement specifically adapted for use on a variety of surfaces, including carpets, putting greens at locations removed from holes, and in actual conjunction with a golf hole. The preferred embodiment includes a relatively thick rectangular planar base member which is adapted to rest upon the putting surface. The preferred base member has at least a limited degree of flexibility so as to conform the contour of the surface. The base member is supplied with a support block for supporting a putting aid element such as a visible flag, an electronic sensor, or some other physical element, such that the putting aid is aligned above and in line with the center of a real or perceived golf hole. The bottom surface of the base member is provided with threaded apertures for optionally receiving spike members which will embed in the putting surface so as to prevent lateral motion of the putting implement when laid upon the surface. In addition, for those instances in which the putting implement is utilized in conjunction with a golf hole, an extension member is provided which is hingedly attached to the front edge of the base member, with the extension member being adapted to extend downward into a golf hole. The preferred extension member includes an arch member which extends laterally from the end of the extension member to abut against the interior of the golf hole in such a manner that the hole itself provides resistance against lateral motion of the putting practice implement.

In the preferred embodiment, the extension member is adapted to fold up against the bottom surface of the base member with the bar portions of the extension nesting within channels formed in the base member and the arch member extending through an aperture in the base. When the extension member is in a retracted orientation, no portion of the extension member extends beneath the bottom surface of the base member. A portion of the arch member extends through above the top surface of the base member to serve as a handle and/or target. In the preferred embodiment, a portion of the rear facing surface of the base member is removed to provide a putting slope which is targeted at the center of the arch receiving aperture. At the front surface of the base member, a semicircular recess is created to correspond to the curvature of a typical golf hole.

An advantage of the present invention is that it is adapted to support a putting aid device directly in conjunction with an actual golf hole.

Another advantage of the present invention is that the putting practice implement is useful in a variety of circumstances and on a variety of surfaces.

Yet another advantage of the present invention is that is readily portable and easy to use.

A further advantage of the present invention is that it is adapted to conform to a variety of putting surfaces and to be resistant to dislodgement from any of the surfaces.

Still another advantage of the present invention is that it may be used as a putting practice element from two distinct directions, depending on the nature of practice desired.

Still another advantage of the present invention is that the interface between the implement and the actual golf hole provides substantial stability for prolonged practice use.

These and other objects and advantages of the present invention will become clear to those skilled in the art upon a review of the following specification, the accompanying drawings and the appended claims.

BEST MODE OF CARRYING OUT THE INVENTION

The present invention is an implement adapted for use by golfers who wish to practice their putting stroke. It is particularly adapted for use with visual elements or other sorts of putting alignment devices such as electronic components. It is adapted to be utilized by golfers on a variety of surfaces, including both actual putting greens and indoor carpets.

Figure 1:
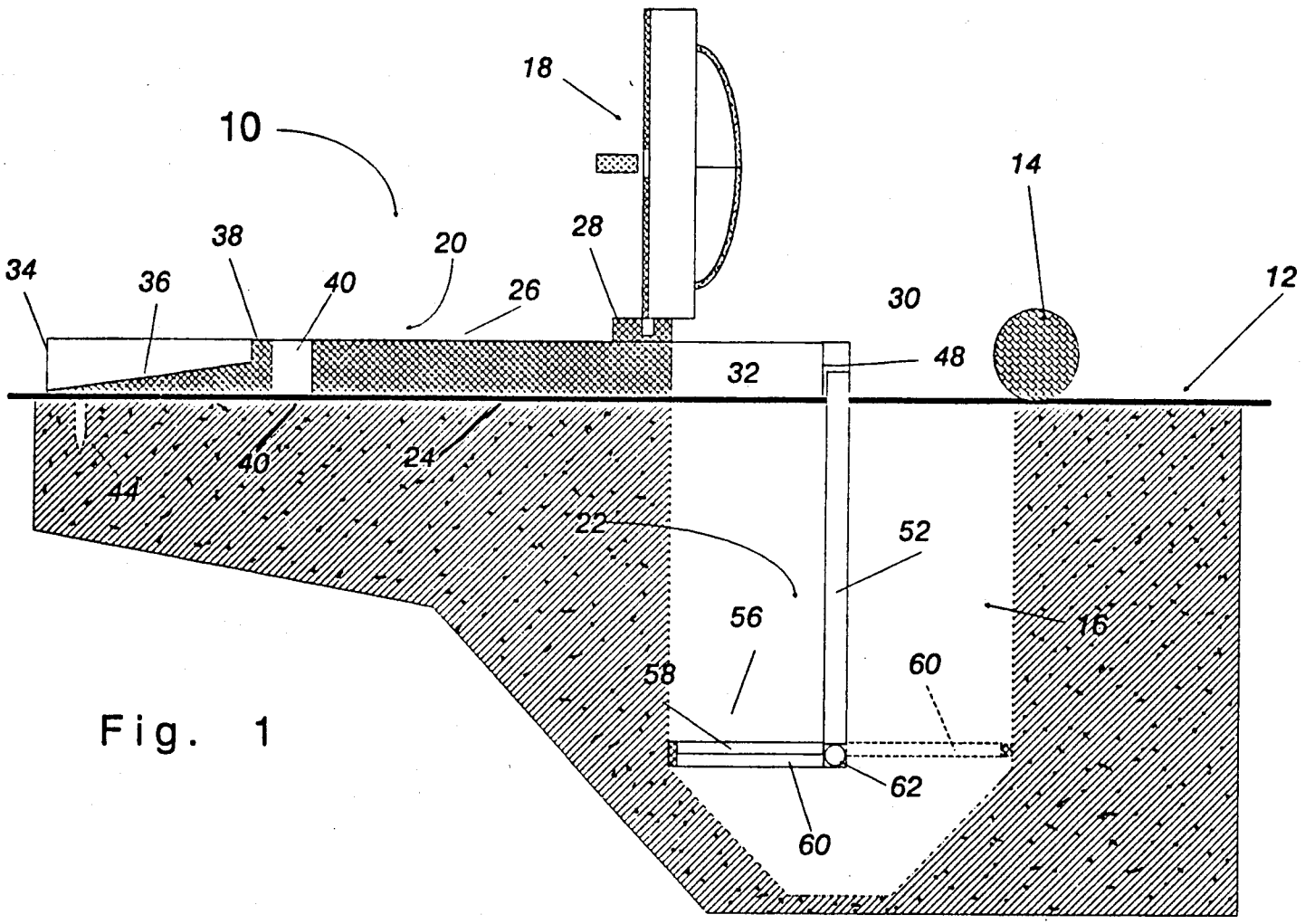
FIG. 1 is a crosssectional view of a preferred embodiment of a putting practice implement according to the present invention, shown with an attached putter alignment aiding device, also shown in conjunction with an actual golf hole installation.

Referring now to FIG. 1, the preferred embodiment of the present invention is illustrated in a crosssectional view taken along a vertical axis of the center of a golf hole and is designated by the general reference character 10. In the illustration of FIG. 1, the putting green practice implement 10 is illustrated as resting upon a putting green surface 12 and is utilized in conjunction with a golf ball 14 and a standard putting cup 16, also referred to as a golf hole. In the illustration in FIG. 1, the putting practice implement 10 is shown as having an alignment aiding device 18 mounted thereon. The stylized alignment aiding device 18 illustrated in FIG. 1 is an electronic signal focusing receiving component, the structure of which is not a part of this invention. The alignment aiding device 18 may be any of a variety of components and may be selected by the user. However, it is intended primarily that the putting implement be utilized with an alignment aiding device 18 which is adapted to interface with a mating component mounting on the golfer's putter in order to cause the golfer to align the putter properly during the putting stroke.

The putting practice implement 10 primarily includes a base member 20 which is adapted to lie upon the putting green surface 12 and an extension member 22 which is adapted to depend from the base member 20 into the putting cup 16 and to provide positioning and stability to the base member 20.

The base member 20 is shown to have a lower surface 24 which abuts against the putting surface 12, and an upper surface 26 which is generally parallel to the lower surface 24 and is separated therefrom by the thickness of the base member 20. In the preferred embodiment 10 the base member 20 has a thickness of approximately 2.5 cm (1 inch) and is constructed of a relatively heavy but generally flexible material such as a heavy rubber.

A device support block 28 is mounted on the upper surface 26 to provide an interface between the base member 20 and the alignment aiding device 18. The support block 28 provides an attachment point, by a screw type attachment in the preferred embodiment, but also by any of a wide variety of other attachment means, and further provides a vertical separation between the alignment aiding device 18 and the putting surface 12. It is desired that the attachment between the alignment aiding device 18 and the support block 28 be relatively rigid in order to maintain proper alignment of the aiding device 18. However, it is also desirable that the support block 28 provide a degree of cushioning such that the components of the alignment aiding device 18 are not damaged by the impact of a golf ball 14 upon the practice implement 10.

Figure 2:
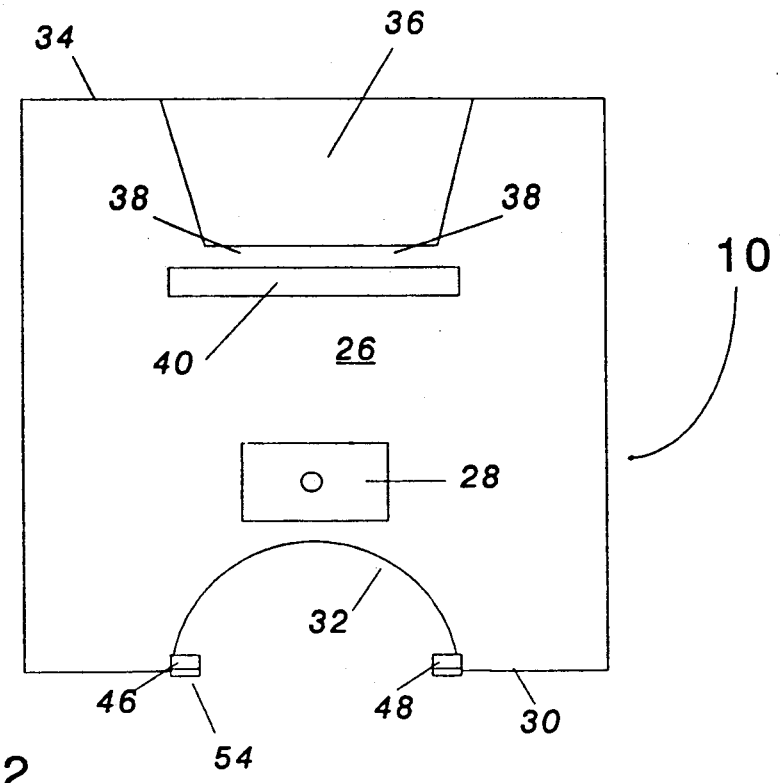
FIG. 2 is a top plan view of the preferred embodiment.

Referring also now to FIG. 2 in which the upper surface 26 is illustrated in a top plan view, it may be seen that the putting practice implement 10 includes a front edge 30, a portion of which is cut away to form a cup rim portion 32. The cup rim portion 32 is selected to have dimensions equivalent to that of one half of a regulation size golf hole 16. Under the rules of golf, the cup rim of the portion 32 is a semicircular rim having a radius of 5.4 cm (2⅛ inches). The height of the cup rim portion 32 is the same as the thickness of the base member 20 and is adapted to be sufficient so as to provide a substantial impediment to a rolling golf ball 14.

As it is also seen from FIG. 2, the base member 20 includes a rear edge 34. In the preferred embodiment 10 the base member 20 is provided with a return slope 36

(see also FIG. 1), which extends from the rear edge 34 to a bumper ridge 38. The return slope 36 is formed such that the thickness of the base member 20 at the exterior edge of the return slope 36 is negligible so as to provide an insignificant impediment to a rolling golf ball 14. The return slope is sloped upward to slow the golf ball 14 before impact with the bumper ridge 38 at the interior end of the return slope 36. The return slope 36 is aligned to be directly opposite the cup rim portion 32. In this manner, both the cup rim portion 32 and the return slope 36 are centered on the base member 20 so as to be aligned in opposite directions with the alignment aiding device 18. This permits the putting practice implement to be utilized in either of two orientations with the golfer practicing by putting toward the cup rim portion 32 or toward the return slope 36, with both orientations being properly arrayed with the alignment aiding device 18.

As is illustrated especially in FIGS. 1 and 2, the base member 20 is provided with a receiving slot 40 therethrough for receiving a portion of the extension member 22. The receiving slot 40 is situated opposite the bumper ridge 38 from the return slope 36 and extends completely through the base member 20.

Figure 3:
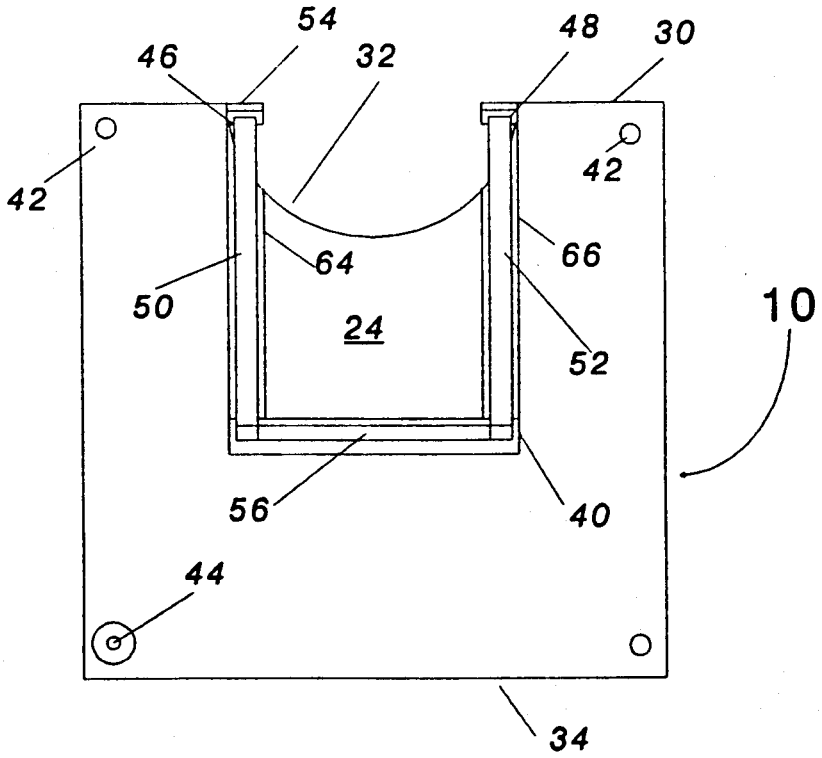
FIG. 3 is a bottom plan view of the preferred embodiment.

As is illustrated particularly in FIGS. 1 and 3, the base member 20 is adapted to be fitted with components which allow it to be secured on a putting surface such as a standard putting green. For this purpose, the lower surface 24 is provided with four threaded apertures 42 near the corners thereof. These threaded apertures 42 are adapted to receive threaded spikes 44 (see FIG. 1, in phantom). The threaded spikes 44 may be a variety of different structures but, in the preferred embodiment, are standard golf spikes such as are applied to golf shoes. Similarly, the threaded apertures 42 are similar to those found embedded in standard golf shoes. The threaded spikes 44 are adapted to be removable such that they are only utilized when desired, such as on a outdoor grass putting green. It is expected that these threaded spikes 44 will be an impediment when utilized on an indoor office carpet, or the like.

Referring again to FIGS. 1 and 3, the base member 20 is provided, near the intersection of the cup rim portion 32 and the front edge 30, with a left hinge 46 and a right hinge 48. The hinges 46 and 48 respectively connect the base member 20 to a left bar member 50 and a right bar member 52, which form a substantial portion of the extension member 22. The left hinge 46 and the right hinge 48 are situated such that the bar members 50 and 52 may depend therefrom into a golf hole 16 in such a manner that the exterior edges of the bar members 50 and 52 are parallel to and approximately abutting against the interior edges of the putting cup 16. The left hinge 46 and the right hinge 48 are provided with rotation stops 54 to prevent the bar members 50 and 52 from rotating to a position more than the 90° depending position illustrated in FIG. 1.

The left bar member 50 and the right bar member 52 terminate at their distal ends at an arch member 56. In the preferred embodiment 10 the arch member 56 includes a first semicircular arch component 58 and a second semicircular component 60, each connected at their ends by an arch hinge 62 to the respective bar members 50 and 52. The first arch component 58 and the second arch component 60 are adapted such that the second arch component 60 rotates about the arch hinge 62 in such a manner as to form a circle with the first arch component 58, with the outside dimension of the circle formed by the arch components 58 and 60 being substantially equivalent to the interior dimension of the putting cup 16. This orientation is illustrated by the phantom drawing of FIG. 1. When the second arch component 60 is rotated 180° about the arch hinge 62, as is shown in the solid line of FIG. 1, the second arch component 60 abuts directly against the congruent first arch component 58 such that only a semi-circular arch member 56 is created.

In order to facilitate maximum engagement between the extension member 22 and the interior of the putting cup 16, thus providing maximum stability to the practice implement 10 when utilized in the extended orientation illustrated in FIG. 1, the dimensions of the bar members 50 and 52 and the arch components 58 and 50 are selected to conform as closely as possible to the interior dimension of a standard putting cup 16. Since the majority of putting cups 16 have a depth of at least 7.5 cm (3 inches) before tapering, the bar members 50 and 52 are adapted to have a length of 7.5 cm. Similarly, the circle formed by the mutually extended arch components 58 and 60 is adapted to have an outside diameter of slightly less than 10.8 cm (4.5 inches) such that it may easily fit within the putting cup 16 but not have a great degree of freedom of movement therewithin.

Since it is intended that the putting practice implement 10 be utilized in locations both in conjunction with a putting cup 16 (FIG. 1) and in other locations where no putting cups is in available, such as in remote areas of a putting green or on another putting surface such as a carpet, it is desirable that the extension member 22 be fully retractable such that the lower surface 24 may rest flat against whatever putting surface 12 is selected. Accordingly, as is illustrated in FIG. 3, the lower surface 24 is provided with a left bar channel 64 and a right bar channel 66. The left bar channel 64 and the right bar channel 66 have width and depth sufficient such that the extension member 22 may be rotated above the left and right hinges 46 and 48 such that the bar members 50 and 52 are received entirely within the bar channels 64 and 66, respectively, while the arch member 56 extends through the receiving slot 40. In the retracted orientation, such as illustrated in FIG. 3, the extension member 22 will not interfere with the flat resting of the lower surface 24 on the putting surface 12.

Figure 4:
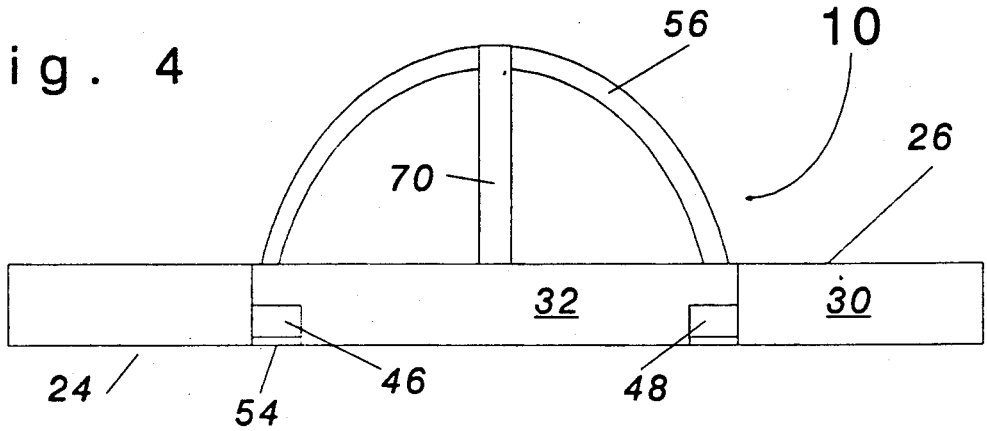
FIG. 4 is a front elevational view of the preferred embodiment showing an optional hole engaging slide installed thereon.

As is illustrated in the front view of FIG. 4, the arch member 56 extends through the base member 20 to a certain degree. In the preferred embodiment this extension is approximately 3 cm (1.2 inches). The degree of extension of the arch member 56 through the receiving slot 40 serves two purposes. The first purpose is that the arch member 56 may be utilized as a handle by which the practice implement 10 may be carried. Additionally, the retracted arch member 56 may be utilized as a visual target when the golfer desires to practice putting toward the return slope 36.

In order to facilitate conversion of the extension member 22 from the extended orientation of FIG. 1 to the retracted orientation of FIGS. 3 and 4, there is required to be a certain degree of flexibility in the interface between the extension member 22 and the base member 20. In the preferred embodiment 10, the base member 20 has a degree of flexibility, as described above, which aids in the conformation of the lower surface 24 to the texture of the putting green 12 as well as providing for ease of retraction of the extension member 22. The extension member 22 is also intended to have a degree a flexibility, with both the bar members 50 and 52 and the arch components 58 and 60 being formed of deformable materials such as medium weight plastic so as to provide maximum conformation to the interior surface of the putting cup 16 and also to facilitate insertion of the arch member 56 through the receiving slot 40.

Various alterations of the precise construction of the component are possible without departing from the spirit of the invention of the putting practice implement 10. Two modifications, in particular, are considered with respect to the arch member 56. Although the preferred embodiment 10 illustrates the arch member as including the first and second arch component 58 and 60 connected by an arch hinge 62, one alternate embodiment, illustrated by the complete solid illustration of FIG. 1, is to form the arch member 56 as a solid component combining the first and second arch members 58 and 60 into a unitary element rigidly attached to the bar member 50 and 52. This construction will be simpler and less expensive to manufacture and will be sufficient for most purposes.

Figure 5:
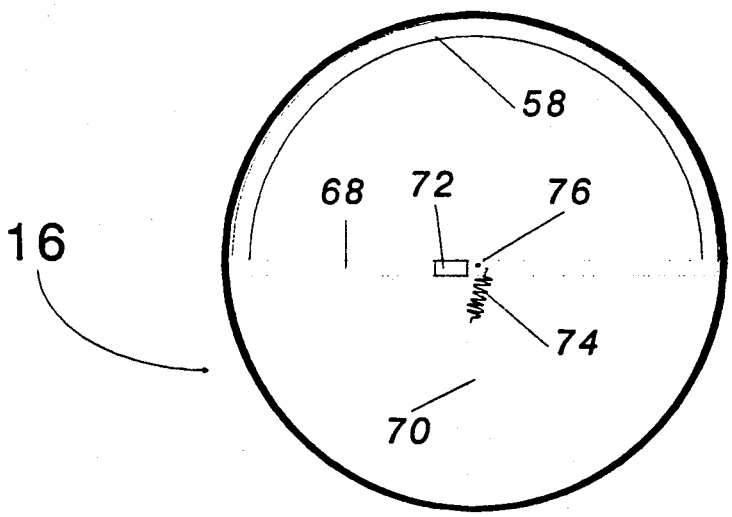
FIG. 5 is a top plan view of the extension member portion of the present invention, showing the interface with the golf hole.

A second modification to the arch member is illustrated in FIGS. 4 and 5 and utilizes a secondary means of securing a tight fit between the exterior of the arch member 56 and the interior of the putting cup 16. In this alternate arch member 56, a cross bar 68 is provided between the ends of the left bar member 50 and the right bar member 52. The cross bar 68 serves a dual purpose of providing structural integrity to the extension member 22 and also as a support for a radial engaging bar 70 which is adapted to extend from the center of the cross bar 68 to the edge of the interior of the putting cup 16 opposite the center of the arch member 56, when extended. The radial engaging bar 70 is adapted to provide stability to the engagement of the extension member 22 with the putting cup 16 by forcing the edge of the arch member 56 against the interior of the putting cup 16. As is shown in FIG. 5, the radial engaging bar 70 may be held in position by a latch 72 and urged toward the extended position by a spring 74. The latch 72 will operate to hold the radial engaging bar 70 in the retracted position (FIG. 4) when extension is not desired. The advantage of the spring 74 urging the radial engaging bar 70 is that this allows for a tight fit even in putting cups 16 which do not conform to specifications. For this purpose, the radial engaging bar 70 is slightly longer than the radius of the arch member 56.

Another method of utilizing a radial engaging bar 70 is illustrated phantom in FIG. 5. In this illustration, the radial engaging bar 70 is connected to the center of the cross bar 68 by a pivot connector 76. In this embodiment, the radial engaging bar may be rotated about the pivot 76 to extend to engage the interior of the putting cup 16 at a position diametrically opposed to the center of the arch member 56. Furthermore, it is easily retracted by rotating about the pivot 76 to rest against the cross bar 68 or extend to the arch member 56, such as illustrated in FIG. 4.

Those stated above are only examples of various modifications which may be made to serve particular purposes of the present invention. Various others modifications of dimensions, materials and features of constructions may be made without departing from the spirit and scope of the invention. Accordingly, the above disclosure is not to be construed as limiting and the appended claims are to be interpreted as encompassing the entire scope of the invention.

INDUSTRIAL APPLICABILITY

The putting practice element of the present invention is adapted for use by golfers who wish to practice putting techniques under a variety of circumstances. It is specially adapted for utilization by a golfers having an alignment aiding device 18 which is extended above the target in order to allow the golfer to check the orientation of the putting stroke. In particular, the putting practice implement 10 is adapted for utilization from two distinct orientations and on a variety of surfaces.

The primary expected utilization of the putting practice implement 10 is that illustrated in FIG. 1, in which the extension member 22 is placed in an extended orientation into the interior of a putting cup 16. In this manner the extension member 2 provides a great deal of lateral stability to the base member 20 and prevents dislodgement or disorientation of the putting practice implement 10 from impact of a golf ball 14 against the implement 10. Additional lateral support, when utilized on a turf putting green 12, is provided by the threaded spikes 44. In this orientation the golfer will align the putter with the alignment aiding device 18, with the orientation of the alignment aiding device 18 being directly behind the center of the golf hole 16 from the golfer's putting location. This is particularly useful for a golfer putting on a flat surface (a putt with no break).

It is also intended that the device will be utilized on positions on a putting green remote from the hole 16. This will occur in situations when a putter wishes to align a putt to determine the amount of break necessary. For example, the target position on a sloping green may be somewhat removed from the cup in order to stroke the golf ball 14 in such a manner that the slope of the green will cause it to break into the cup. For this purpose it may be desirable for the alignment aiding device 18 to be situated at a position laterally offset from the putting cup 16. When this sort of utilization is desired, the practice implement 10 is utilized in the retracted orientation (FIGS. 3 and 4) wherein the lower surface 24 conforms to the putting green surface in whatever location is selected. Since impact is not expected in this orientation it may not be necessary to have the additional support which is provided by the spikes 44. It is noted that no support is obtained in this orientation from the extension member 22.

There will be instances in which the golfer wishes to practice putting and does not have a putting green available which has precut holes. In this instance, the golfer may wish to use the practice implement in the retracted orientation as a stand alone device. In the retracted orientation the target and desired impact location for the golf ball 14 are both provided by the implement 10. Since the cup rim 32 is the same width as a standard golf hole, as is the return slope 36 at its intersection with the rear edge 34, the golfer has the same sort of target available as with an actual golf hole. The alignment aiding device 18 is also usable as a target, as is the portion of the arch member 34 which extends through the receiving slot 40 and is visible above the upper surface 26. Further, in the event the golfer utilizes the rear of the device as a target, then the return slope 36 will provide at least a chance that the ball will roll back toward the golfer, thus minimizing the effort in repeating of wide variety of strokes.

If the implement 10 is to be utilized on a surface such as a carpet it is usually not desirable to incorporate the threaded spikes 44 to prevent lateral motion. In such an instance, the friction between the lower surface 24 and the carpet surface is usually sufficient to prevent an undesirable amount of shifting, although some other form of anchoring may be desirable.

When user wishes to utilize the implement 10 on a putting surface, such as a mowed turf surface or a putting green in which holes have not been cut, then the threaded spikes 44 may be utilized for added stability.

Due to the versatility of the present invention, it is expected that a wide spectrum of golfers wishing to practice putting strokes will have potential utility for the device. Especially in the event that the electronic alignment aiding device become widely popular, the utility will be advanced. Since the putting practice implement 10 of the present invention may be easily and inexpensive manufactured, is economical in space usage, and is constructed so as to be durable, it is expected that the commercial utility and industrial applicability of the present invention will be both broad in scope and long lasting in duration.

I claim:

1. A putting green practice implement for golfers, for use on a putting surface including a golf hole, comprising:

a base member having an upper surface and a generally planar lower surface for resting on the putting surface, the base member being pliable so as to generally conform to the putting surface and including, along at least one circumferential surface thereof, a generally semicircular indentation such that when the base member is placed upon the putting surface the edges of said indentation may be aligned with the golf hole in such a manner that a semicylindrical portion of the base member immediately surrounding said indentation provides an upward extension of the sides of the golf hole, while vertical access to the golf hole is unimpeded; and position securing means for minimizing inadvertent alteration of the position of the implement including an extension member to depend from the base member into the golf hole.

2. The putting green practice implement of claim 1 wherein the position securing means further includes a plurality of spike members depending from said lower surface, such that said spike members embed into the green when the implement is placed thereon.

3. The putting green practice implement of claim 1 and further including support platform means situated upon said upper surface for supporting an alignment element thereon in such a manner that said alignment element is positioned above a point lying along a line including the center of said hole and the center of said indentation.

4. The putting green practice implement of claim 1 wherein said semicircular portion of the base member has a height of at least a majority of the diameter of a golf ball so as to impede a rolling golf ball from engaging said upper surface.

5. The putting green practice implement of claim 1 wherein said extension portion is attached to the base member by hinge means in such a manner that said extension portion may be rotated about said hinge means to depend into the golf hole, and may be retraced by further rotation into abutment with channels formed in said lower surface of the base member such that said lower surface may rest against the putting surface without being impeded by said extension portion.

6. The putting green practice implement of claim 5 wherein said extension portion includes a pair of bar members attached to the base member at respective hinges situated adjacent to said circumferential surface, and an arch member for closely approximating the interior shape of one half of said hole.

7. The putting green practice implement of claim 6 wherein a receiving slot is provided in the base member such that said arch member extends therethrough when said extension member is retracted.

8. In a device supporting an object above a relatively flat putting surface includes a ball receiving hole formed therein, the improvement comprising:

providing the device with a laterally extending base member having a generally planar lower surface for resting upon an area of the flat putting surface; and providing hole engaging means for depending into the ball receiving hole in a manner such that the hole engaging means impedes lateral motion of the device with respect to the flat surface.

9. The improvement of claim 10 wherein the hole engaging means includes an extension member hingedly attached to said base so as to depend therefrom in at least one orientation.

10. The improvement of claim 11 wherein said base member includes, on said lower surface thereof, receiving channel means for receiving said extension member therewithin in a retracted orientation, such retracted orientation being characterized by no portion of said extension member extending beneath said lower surface of said base member.

11. The improvement of claim 9 wherein said extension member includes a pair of opposed side bars hingedly attached to said base member at one end thereof and an arch member attached to the opposite end thereof, said arch member being shaped so as to correspond to the interior one half cross section of a standard golf hole.

12. The improvement of claim 11 wherein said arch member further includes a diametrical slide member adapted to slidably extend so as to engage the opposing interior surface of the golf hole from the surface engaged by the exterior surface of said arch member.

13. The improvement of claim 12 wherein said channel means includes a pair of parallel longitudinal channels for receiving said side bars, said longitudinal channels further including hinge means for attaching said side bars to said base member, and an aperture for receiving said arch member therein.

14. The improvement of claim 13 wherein said arch member extends through said base member to such an extent in said retracted orientation that a substantial portion of said arch member is accessible from above the top surface of said base portion.

15. The improvement of claim 11 wherein said arch member includes an arch hinge and two semicircular arches joined by said arch hinge, one of said arches being rotatable about said arch hinge such that a circular structure is formed by said arches and said arch hinge.

16. The improvement of claim 11 wherein said arch member is provided with opposing side engaging means for engaging the opposing interior wall of the golf hole so as to form a secure fit therewith.

17. A putting practice implement for use on a generally horizontal surface to support sensory elements adapted to aid a golfer in develop a consistent putting stroke, comprising:

a base for conforming to the contour of the generally horizontal surface so as to rest firmly thereon, the base including support structure for the sensory elements, and a hole conforming portion adapted to conform to a portion of the upper edge of a conventional golf hole;

retractable extension means attached to the base for optionally engaging a conventional golf hole so as to prevent inadvertent dislodgement of the implement from the vicinity of the golf hole.

18. The implement of claim 17 wherein the base is further provided with a return slope portion for gravitationally redirecting a putted golf ball rolling up said return slope back in the general direction from which the golf ball impacted said return slope portion.

* * * * *